US010488786B2

(12) United States Patent
Fukumoto et al.

(10) Patent No.: US 10,488,786 B2
(45) Date of Patent: Nov. 26, 2019

(54) DEVELOPMENT DEVICE AND IMAGE FORMING APPARATUS INCLUDING THE DEVELOPMENT DEVICE

(71) Applicant: SHARP KABUSHIKI KAISHA, Sakai, Osaka (JP)

(72) Inventors: Shohei Fukumoto, Sakai (JP); Motoyuki Itoyama, Sakai (JP); Hiroo Naoi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/212,476

(22) Filed: Dec. 6, 2018

(65) Prior Publication Data

US 2019/0179236 A1 Jun. 13, 2019

(30) Foreign Application Priority Data

Dec. 7, 2017 (JP) ..... 2017-234789

(51) Int. Cl.
*G03G 15/08* (2006.01)

(52) U.S. Cl.
CPC ..... *G03G 15/0849* (2013.01); *G03G 15/0865* (2013.01)

(58) Field of Classification Search
CPC ..... G03G 15/0849; G03G 15/0865; G03G 15/0856; G03G 21/1652
See application file for complete search history.

(56) References Cited

U.S. PATENT DOCUMENTS

2016/0378039 A1* 12/2016 Watanabe ..... G03G 15/556 399/30

FOREIGN PATENT DOCUMENTS

JP 2004-139038 A 5/2004

* cited by examiner

*Primary Examiner* — Hoang X Ngo
(74) *Attorney, Agent, or Firm* — ScienBiziP, P.C.

(57) ABSTRACT

A development device includes a developer housing, a toner concentration detection sensor, and a cover member. The developer housing stores a developer containing toner and a carrier. The toner concentration detection sensor is attached to a lower surface of the developer housing and is configured to detect a toner concentration of the developer stored in the developer housing. The cover member is attached to the lower surface of the developer housing to cover the toner concentration detection sensor. The cover member includes a pressing section for pressing a part of the toner concentration detection sensor against the lower surface of the developer housing.

11 Claims, 14 Drawing Sheets

DEVELOPMENT DEVICE AND IMAGE FORMING APPARATUS INCLUDING THE DEVELOPMENT DEVICE

BACKGROUND

1. Field

The present disclosure relates to a development device and an image forming apparatus including the development device. More particularly, for example, the present disclosure relates to a development device that includes a toner concentration sensor for detecting a toner concentration of a developer stored in a developer tank and an image forming apparatus that includes the development device.

2. Description of the Related Art

An example development device is disclosed in Japanese Unexamined Patent Application Publication No. 2004-139038. The development device disclosed in Japanese Unexamined Patent Application Publication No. 2004-139038 includes a developer storage unit for storing a two-component developer consisting of toner and magnetic particles and a toner concentration detector for detecting a toner concentration of the developer in the developer storage unit. The toner concentration detector is fixed to an outer wall of the developer storage unit of the development device by a snap-fit provided on the outer wall of the developer storage unit.

Japanese Unexamined Patent Application Publication No. 2004-139038 also discloses another structure of the development device in which, instead of the snap-fit, the toner concentration detector is fixed to the outer wall of the developer storage unit by a double-faced tape.

Such a known development device, however, fails to sufficiently press the toner concentration detector to the outer wall of the developer storage unit by either the fixing by snap-fit or the fixing by double-faced tape and accordingly, the fixation of the toner concentration detector with respect to the outer wall of the developer storage unit may become loose. The loose fixation of the toner concentration detector with respect to the outer wall of the developer storage unit may unable the development device to adequately detect the concentration of the toner in the developer tank.

SUMMARY

It is desirable to provide a novel development device and an image forming apparatus including the development device.

Furthermore, it is desirable to provide a development device capable of appropriately detect a concentration of toner in a developer tank and an image forming apparatus including the development device.

According to an aspect of the disclosure, there is provided a development device including a developer tank configured to store a developer, a toner concentration sensor attached to a lower surface of the developer tank, the toner concentration sensor being configured to detect a toner concentration of the developer stored in the developer tank, and a cover member attached to the lower surface of the developer tank to cover the toner concentration sensor. The cover member includes a pressing section for pressing a part of the toner concentration sensor against the lower surface of the developer tank.

According to another aspect of the disclosure, there is provided an image forming apparatus including the development device.

DESCRIPTION OF THE EMBODIMENTS

First Embodiment

Figure 1:
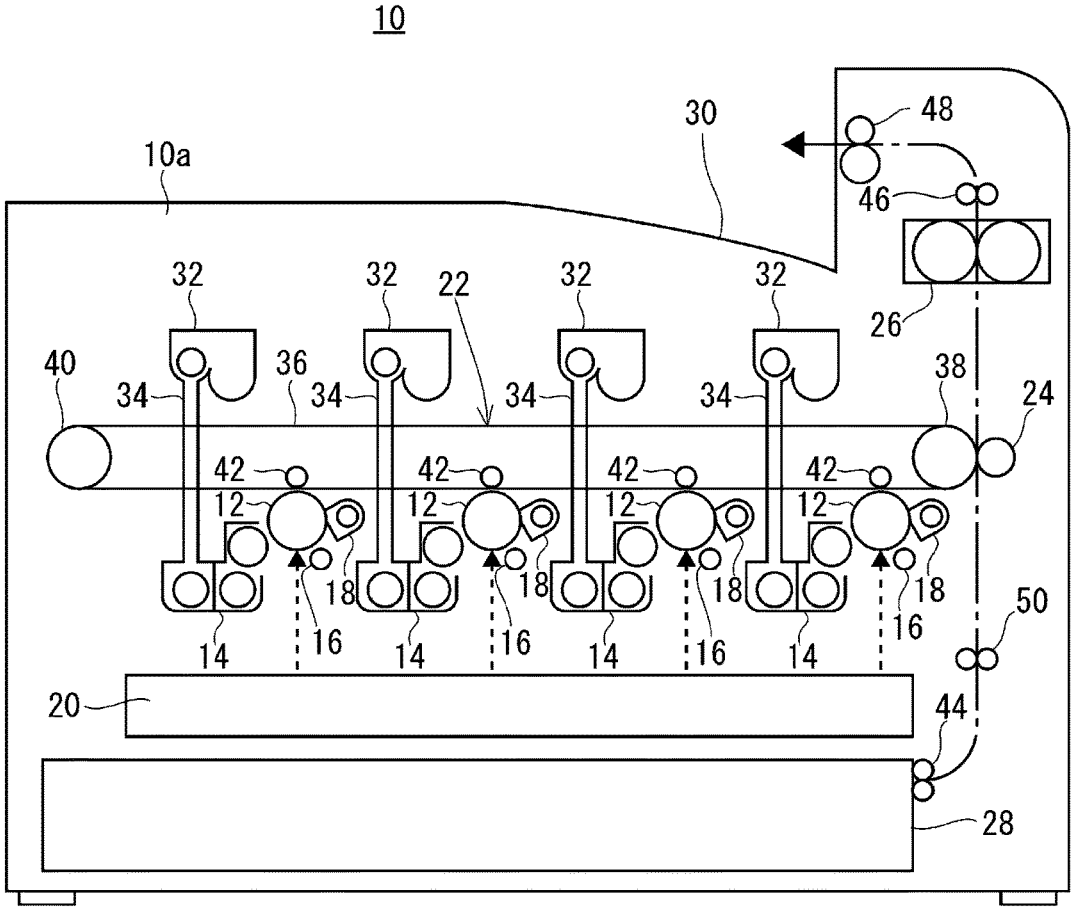
FIG. 1 illustrates an example schematic overall structure of an image forming apparatus according to a first embodiment.

FIG. 1 is a schematic front view of an overall structure of an image forming apparatus 10 according to a first embodiment of the disclosure.

In FIG. 1, the image forming apparatus 10 according to the first embodiment is a color printer that forms a multicolor or monochrome image on paper (recording medium) by electrophotography. The image forming apparatus 10 may be a monochrome printer. The image forming apparatus 10 is not limited to the printers, and may be a copying machine, a facsimile, or a multifunction peripheral having these functions.

In this specification, when the image forming apparatus 10 is viewed from the front side, in the horizontal directions, the left side is defined as the left direction and the right direction is defined as the right direction. When the image forming apparatus 10 is viewed from above (below), in the depth direction, the front side of the image forming apparatus 10 is defined as the forward direction (front direction) and the back side of the the image forming apparatus 10 is defined as the backward direction (back direction).

First, a basic structure of the image forming apparatus 10 will be briefly described. As illustrated in FIG. 1, the image forming apparatus 10 includes photosensitive drums 12, development devices 14, chargers 16, cleaning units 18, an exposure device 20, an intermediate transfer belt unit 22, a secondary transfer roller 24, a fixing unit 26, and other components. The image forming apparatus 10 forms an image onto paper conveyed from a paper feed tray 28 and discharges the paper on which the image has been formed to a discharge tray 30. Image data to be formed on paper is input from an external computer. When the image forming apparatus 10 has a scanner function, however, not only the externally input image data, but also image data read from a document by the scanner may be used.

The above-mentioned components are accommodated in a casing 10*a* of the image forming apparatus 10. In the casing 10*a* of the image forming apparatus 10, a controller (not illustrated) that includes a central processing unit (CPU) and a memory is provided. The controller sends control signals to the components in the image forming apparatus 10 to instruct the image forming apparatus 10 to perform various operations.

The image data processed in the image forming apparatus 10 corresponds to four color images of black (BK), magenta (M), cyan (C), and yellow (Y). Accordingly, four photosensitive drums 12, four development devices 14, four chargers 16, and four cleaning units 18 are provided to form four latent images corresponding to the respective colors and these components constitute four image stations. For example, the four image stations may be arranged in a line along a traveling direction (circumferential movement direction) of a surface of an intermediate transfer belt 36, and from a downstream side in the traveling direction of the intermediate transfer belt 36, that is, from a side close to the secondary transfer roller 24, the image stations for black, magenta, cyan, and yellow may be arranged in this order. The arrangement order of the respective colors may be changed appropriately.

In each image station, the charger 16, the development device 14, and the cleaning unit 18 are arranged in this order around the photosensitive drum 12 in the rotation direction (in the counterclockwise direction in FIG. 1). The development device 14 is arranged such that a rotational axis of a development roller (not illustrated) is parallel to a rotational axis of the photosensitive drum 12. The charger 16 is arranged such that its rotational axis is parallel to the rotational axis of the photosensitive drum 12. The cleaning unit 18 is arranged such that a longitudinal direction of a cleaning blade (not illustrated) is the same as the rotational axis direction of the photosensitive drum 12. In FIG. 1, the rotational axis direction of the photosensitive drum 12 is the depth direction (front-back direction) when the image forming apparatus 10 is viewed from the back side.

The photosensitive drum 12 is an image carrier having a photosensitive layer (photoconductive layer) on a conductive base, and is supported by a drive unit (not illustrated) so as to be rotatable about the axis line. The base may have various shapes such as a cylindrical shape, a columnar shape, a thin film sheet, or the like. The photosensitive layer is formed of a material that exhibits conductivity when irradiated with light. The photosensitive drum 12 according to the first embodiment includes a cylindrical base formed of aluminum, and a photosensitive layer formed of amorphous silicon (a-Si), selenium (Se), or an organic optical semiconductor (OPC), and the photosensitive layer is formed on an outer circumferential surface of the base.

The development device 14 visualizes (forms a toner image) an electrostatic latent image formed on the surface of the photosensitive drum 12 with toner. To the development device 14, a toner cartridge 32 is connected via a toner supply pipe 34. The toner cartridge 32 is a container that stores unused toner and carrier. The toner cartridge 32 is disposed above the development device 14 and used to supply (refill) the toner and refill the carrier to the development device 14. The toner supply pipe 34 couples (connects) the toner cartridge 32 and a toner supplying portion of the development device 14.

The charger 16 is a device for charging the surface of the photosensitive drum 12 to a predetermined polarity and potential. The charger 16 may be a brush-type charging device, a roller-type charging device, a corona discharging device, an ion generating device, or the like.

After a toner image has been transferred from the photosensitive drum 12 onto the intermediate transfer belt 36, the cleaning unit 18 removes and collects the toner remaining on the surface of the photosensitive drum 12 to clean the surface of the photosensitive drum 12. Accordingly, for example, the cleaning unit 18 includes a cleaning blade that is a plate-like member for scraping the toner and a collection container for collecting the scraped toner.

The exposure device 20 is disposed below the development device 14. The exposure device 20 is a laser scanning unit (LSU) that includes a laser emitting unit, a reflecting mirror, and the like. The exposure device 20 exposes the surface of the charged photosensitive drum 12 with light to form an electrostatic latent image corresponding to the image data onto the surface of the photosensitive drum 12.

The intermediate transfer belt unit 22 includes, for example, the intermediate transfer belt 36, a drive roller 38, a driven roller 40, and four intermediate transfer rollers (primary transfer rollers) 42, and is disposed on the photosensitive drums 12.

The intermediate transfer belt 36 is a flexible endless belt, and is formed of a synthetic resin, rubber, or the like that is mixed with a conductive material such as carbon black. The intermediate transfer belt 36 is stretched by a plurality of rollers such as the drive roller 38 and the driven roller 40 and is disposed such that the surface (outer circumferential surface) of the intermediate transfer belt 36 is in contact with the surfaces of the photosensitive drums 12. The intermediate transfer belt 36 rotates (circulates) in a predetermined direction (in FIG. 1, the counterclockwise direction) as the drive roller 38 is driven and rotated.

The drive roller 38 is disposed so as to be rotated about its axis by a driving unit (not illustrated). The driven roller 40 rotates as the intermediate transfer belt 36 circulates while applying a predetermined tension to the intermediate transfer belt 36 to reduce the slack in the intermediate transfer belt 36.

The intermediate transfer rollers 42 are disposed so as to face respective photosensitive drums 12 across the intermediate transfer belt 36. The intermediate transfer rollers 42 are pressed against the inner circumferential surface of the intermediate transfer belt 36 and rotated as the intermediate transfer belt 36 rotates. To the intermediate transfer rollers 42, although not illustrated, a transfer power source for applying a transfer bias is connected. In image formation, a voltage of a polarity opposite to the charge polarity of the toner of the toner images that have been formed on the photosensitive drums 12 is applied to the intermediate transfer rollers 42. Consequently, a transfer electric field is formed between the photosensitive drums 12 and the intermediate transfer belt 36, and by the action of the transfer electric field, the toner images formed on the photosensitive drums 12 are transferred to the outer circumferential surface of the intermediate transfer belt 36. For example, to form a color image, toner images of respective colors formed on the respective photosensitive drums 12 are sequentially transferred (primary transfer) and superimposed onto the intermediate transfer belt 36 to form a multicolor tone image on the outer circumferential surface of the intermediate transfer belt 36.

At a position opposite to the drive roller 38 across the intermediate transfer belt 36, a secondary transfer roller 24 is disposed. To the secondary transfer roller 24, a transfer power source (not illustrated) is connected and with the transfer power source, a voltage (secondary transfer voltage) is applied to the secondary transfer roller 24. While paper passes through the transfer nip region between the intermediate transfer belt 36 and the secondary transfer roller 24, by the action of the transfer electric field formed by the voltage-applied secondary transfer roller 24, the toner image that has been formed on the outer circumferential surface of the intermediate transfer belt 36 is transferred (secondary transfer) onto the paper. Then, the toner remaining on the intermediate transfer belt 36 is removed and collected by a transfer belt cleaning unit (not illustrated).

The fixing unit 26 includes, for example, a heating roller and a pressure roller and is disposed above the secondary transfer roller 24. The heating roller is set to a predetermined fixing temperature. While the paper passes through the fixing nip region between the heating roller and the pressure roller, the toner image that has been transferred onto the paper is melted, mixed, and pressure-contacted, and thereby the toner image is thermally fixed onto the paper.

In the casing 10*a* of the image forming apparatus 10, a paper conveyance path for conveying the paper placed on a paper feed tray 28 via the secondary transfer roller 24 and the fixing unit 26 to the discharge tray 30 is formed. Along the paper conveyance path, paper conveyance components such as conveyance rollers 44, 46, and 48 and a registration roller 50 are appropriately disposed.

In image formation, sheets of paper placed on the paper feed tray 28 are guided one by one by a pickup roller (not illustrated) and conveyed to the registration roller 50 by the conveyance roller 44. The registration roller 50 conveys the sheet to the secondary transfer roller 24 when a leading edge of the sheet and a leading edge of the toner image on the intermediate transfer belt 36 are aligned and the toner image is transferred onto the sheet. Then, the sheet passes through the fixing unit 26 and unfixed toner on the sheet is melted and fixed by heat. The sheet is discharged onto the discharge tray 30 via the conveyance rollers 46 and 48.

In such an image forming apparatus 10, as will be described below, a developer (two-component developer) that includes a toner of black, cyan, magenta, or yellow and a carrier is stored in a developer housing (developer tank) 140 in the development device 14. The carrier is a magnetic material such as iron powder or ferrite. The same applies in the following description.

For example, the development device 14 is a trickle-development device. Briefly, the trickle development method is a method of sequentially replacing deteriorated carrier in the development device 14 with a new carrier. The new carrier has been mixed with the toner in the toner cartridge 32 at a predetermined ratio and when the toner is supplied (refilled), the new carrier is supplied (refilled) into the development device 14 and the excess developer is discharged from the development device 14.

In this specification, a simple expression "developer is discharged" means that a deteriorated carrier or a developer that is a mixture of a deteriorated carrier and toner is discharged. Furthermore, although the deteriorated carrier is not always replaced with an unused carrier, basically, the development device 14 can replace the deteriorated carrier with the unused carrier.

In the development device 14, the toner that has been consumed by image formation onto sheets is refilled with the developer that contains the toner of an amount corresponding to the consumed toner. For this purpose, on a bottom section of the developer housing 140, a toner concentration detection sensor (toner concentration sensor) 60 (see FIG. 2) is disposed, and based on an output of the toner concentration detection sensor 60, a toner concentration in the developer housing 140 (T/D: T is toner and D is developer) is detected. Based on the detected toner concentration, the supply of the developer is controlled.

In known development devices, such a toner concentration detector is fixed to an outer wall of a developer housing by a snap-fit provided on the outer wall of the developer housing or a double-faced tape.

The known development devices, however, fail to sufficiently press the toner concentration detection sensor to the outer wall of the developer housing by either the fixing by snap-fit or the fixing by double-faced tape and accordingly, the fixation of the toner concentration detection sensor may become loose with respect to the outer wall of the developer housing. In other words, the distance from the toner concentration detection sensor to the inner surface of the developer housing is increased.

Figure 3:
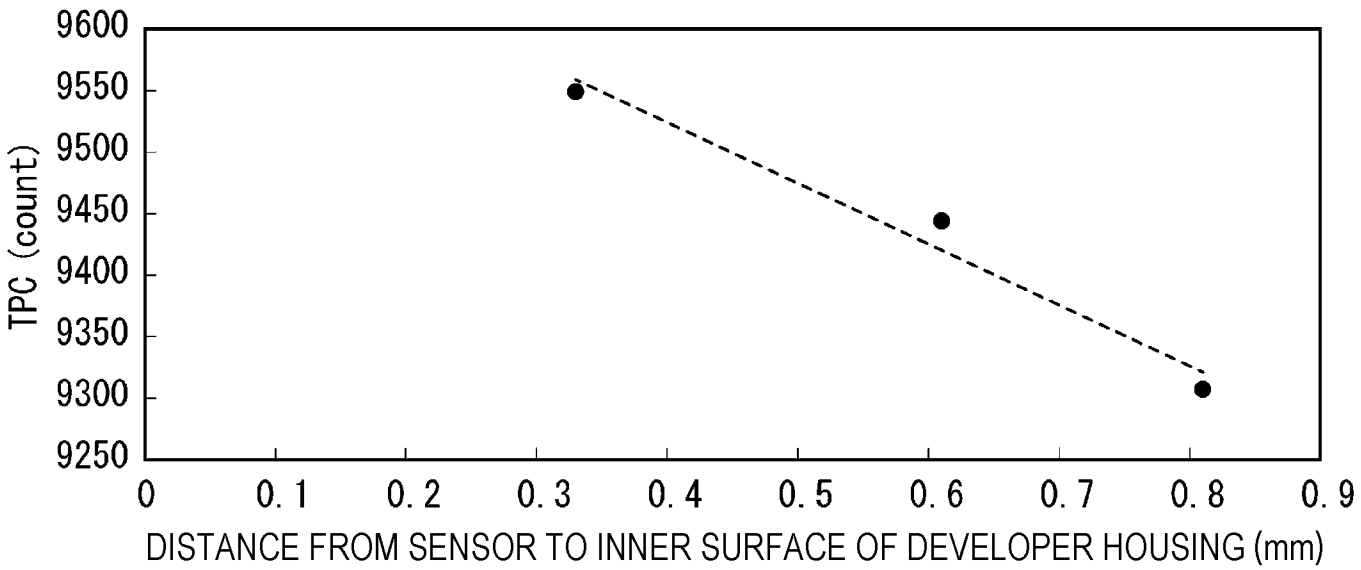
FIG. 3 is a graph illustrating a relationship between a distance from a sensor to an inner surface of a developer tank and a sensor output value.

FIG. 3 is a graph illustrating a relationship between a distance from a toner concentration detection sensor to an inner surface of a developer housing and a sensor output value. In the graph in FIG. 3, "TPC" means a value (timer pulse counter) obtained by dividing a frequency (output value) output from a frequency-type toner concentration detection sensor and counting one divided frequency cycle. FIG. 3 shows that the output value of the toner concentration detection sensor changes by about 2% as the distance from the toner concentration detection sensor to the inner surface of the developer housing changes by 0.1 mm. As described above, the loose fixation of the toner concentration detection sensor with respect to the outer wall of the developer housing may cause an error in the output value of the toner concentration detection sensor and may cause inaccurate detection in the toner concentration in the developer housing.

To solve the problem, in the first embodiment, a cover member 70 that covers the toner concentration detection sensor 60 is provided on a lower surface of the developer housing 140 such that the cover member 70 presses the toner concentration detection sensor 60 against the lower surface of the developer housing 140.

Figure 2:
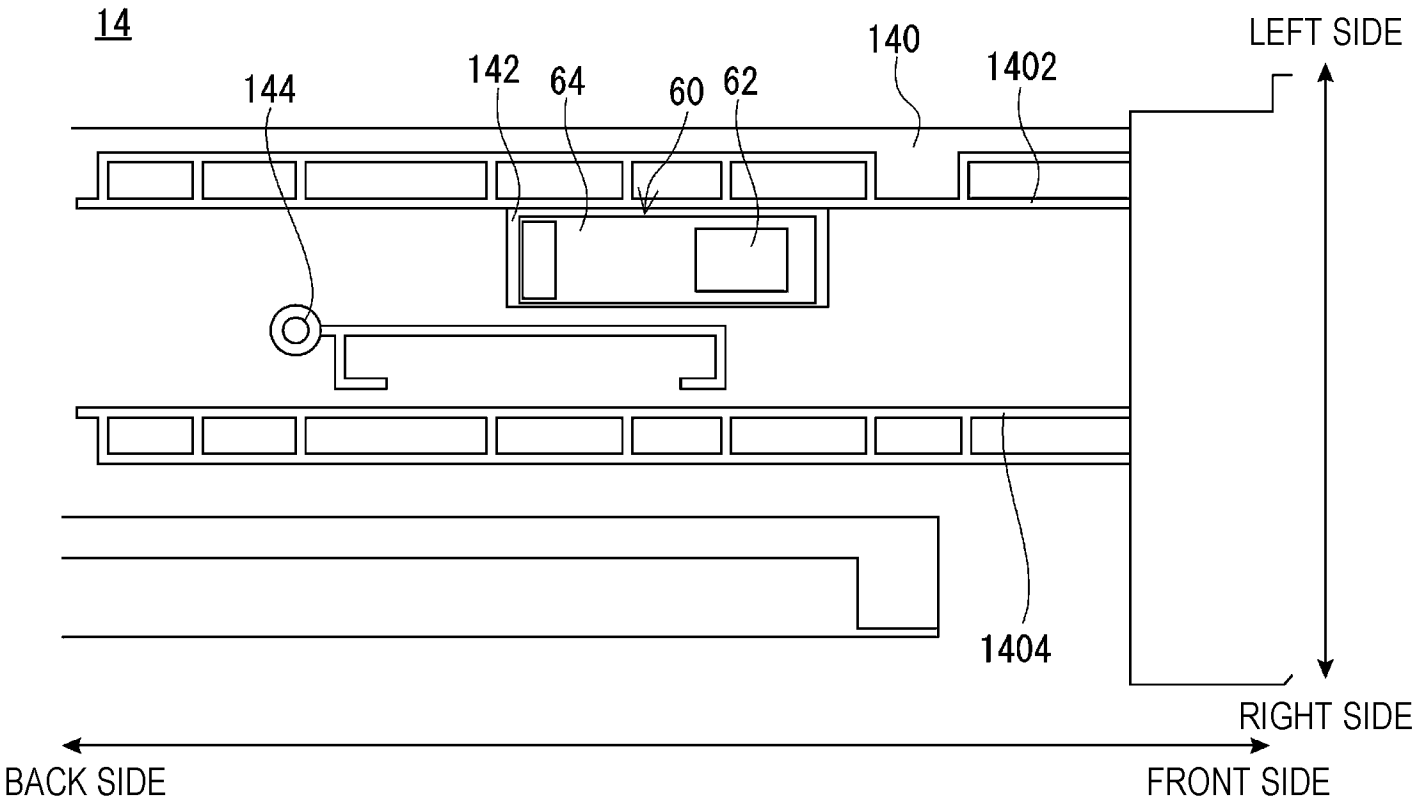
FIG. 2 is a bottom view of a development device in FIG. 1.
Figure 4:
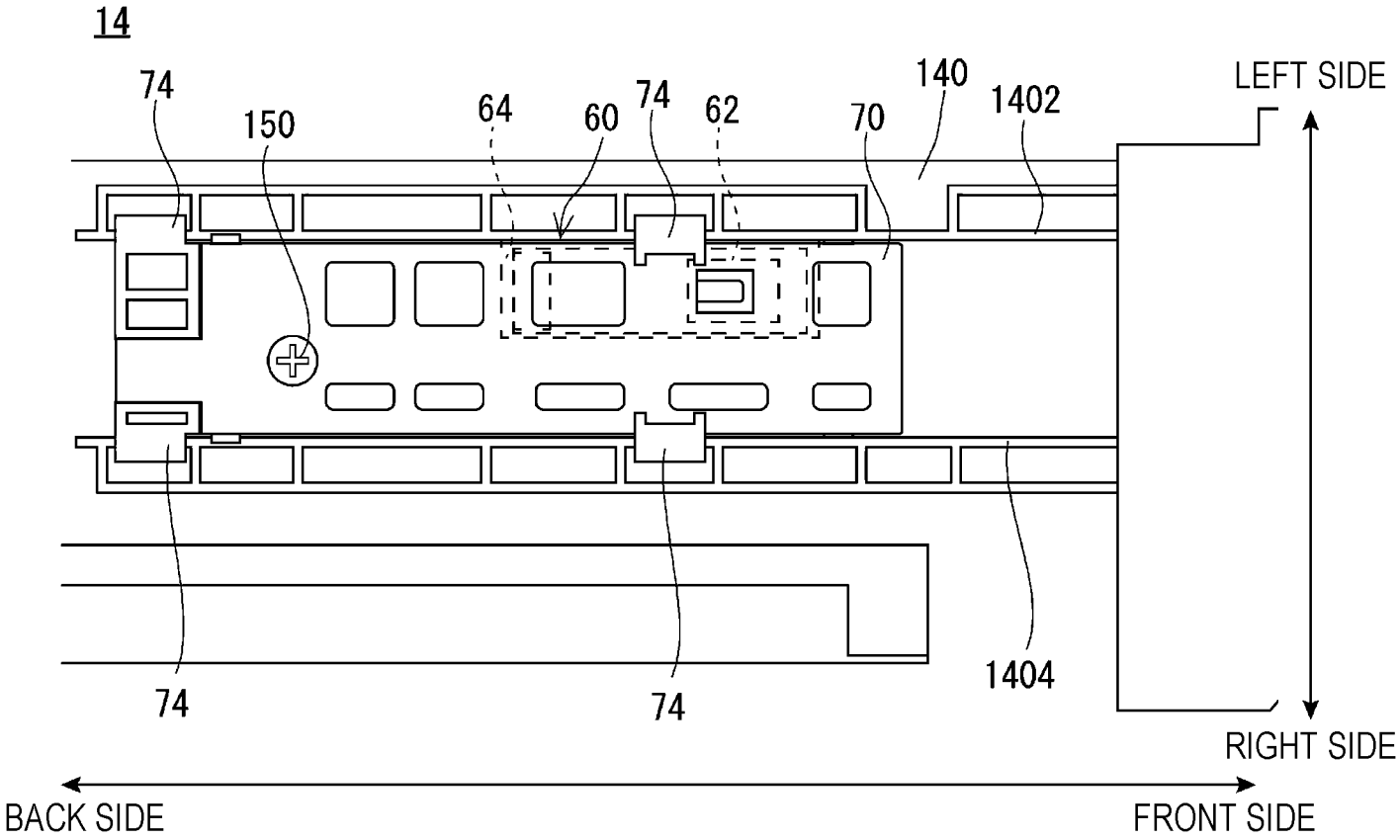
FIG. 4 is a bottom view of a development device to which a cover member is attached.
Figure 5A:
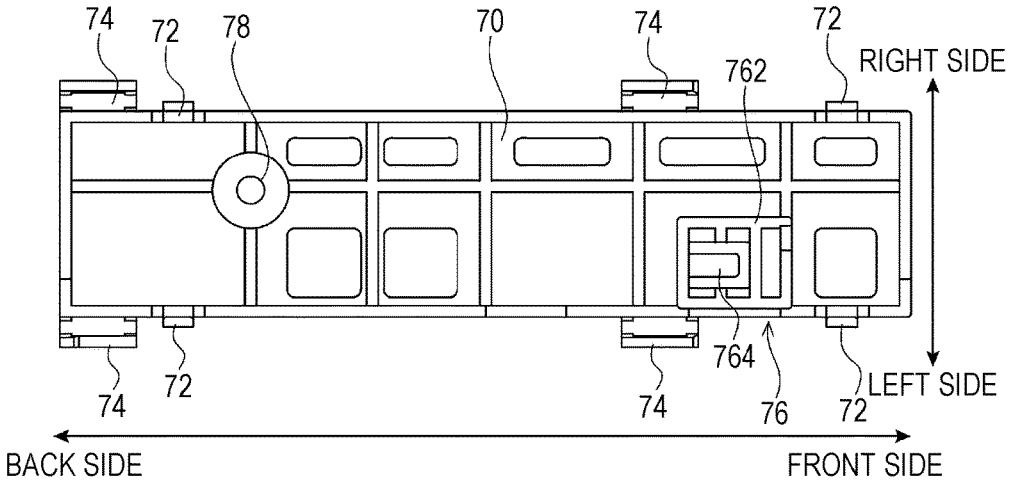
FIG. 5A is a top view of a cover member.
Figure 5B:
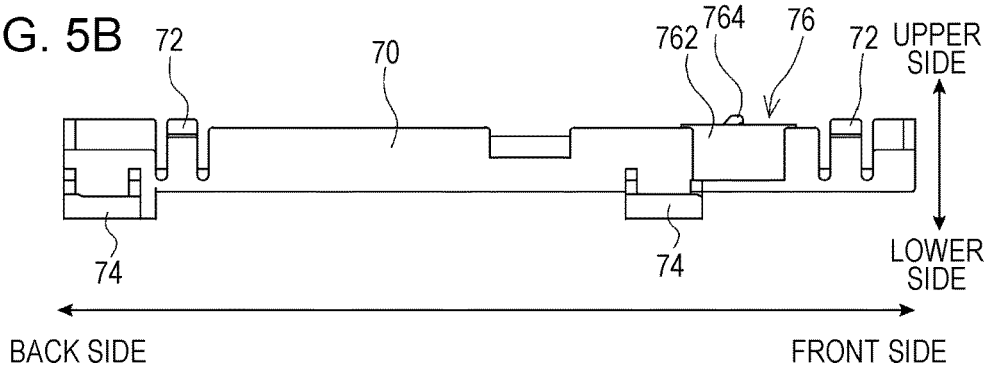
FIG. 5B is a side view of a cover member.
Figure 5C:
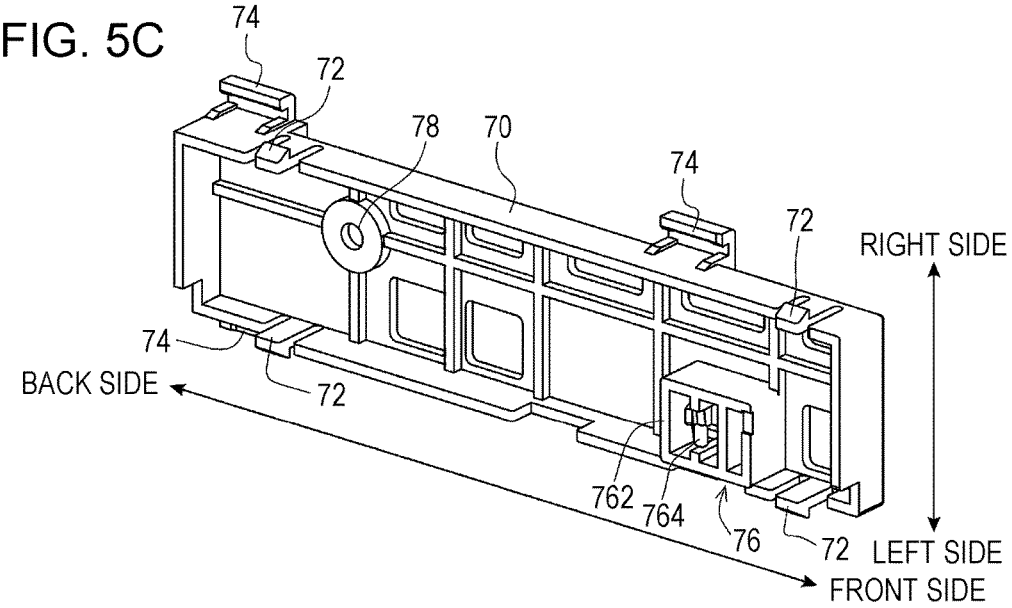
FIG. 5C is a perspective view of a cover member viewed diagonally from above.
Figure 6:
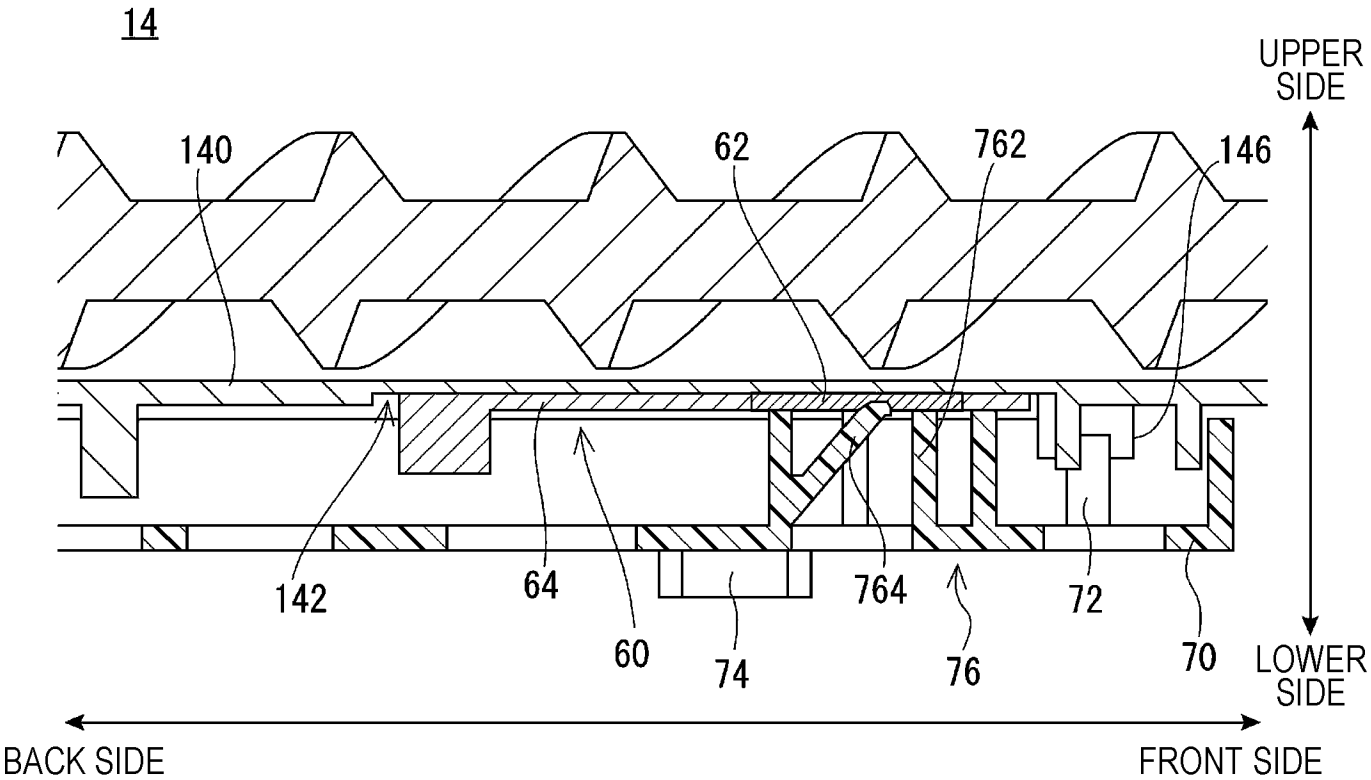
FIG. 6 is a schematic cross-sectional side view of a development device.
Figure 7:
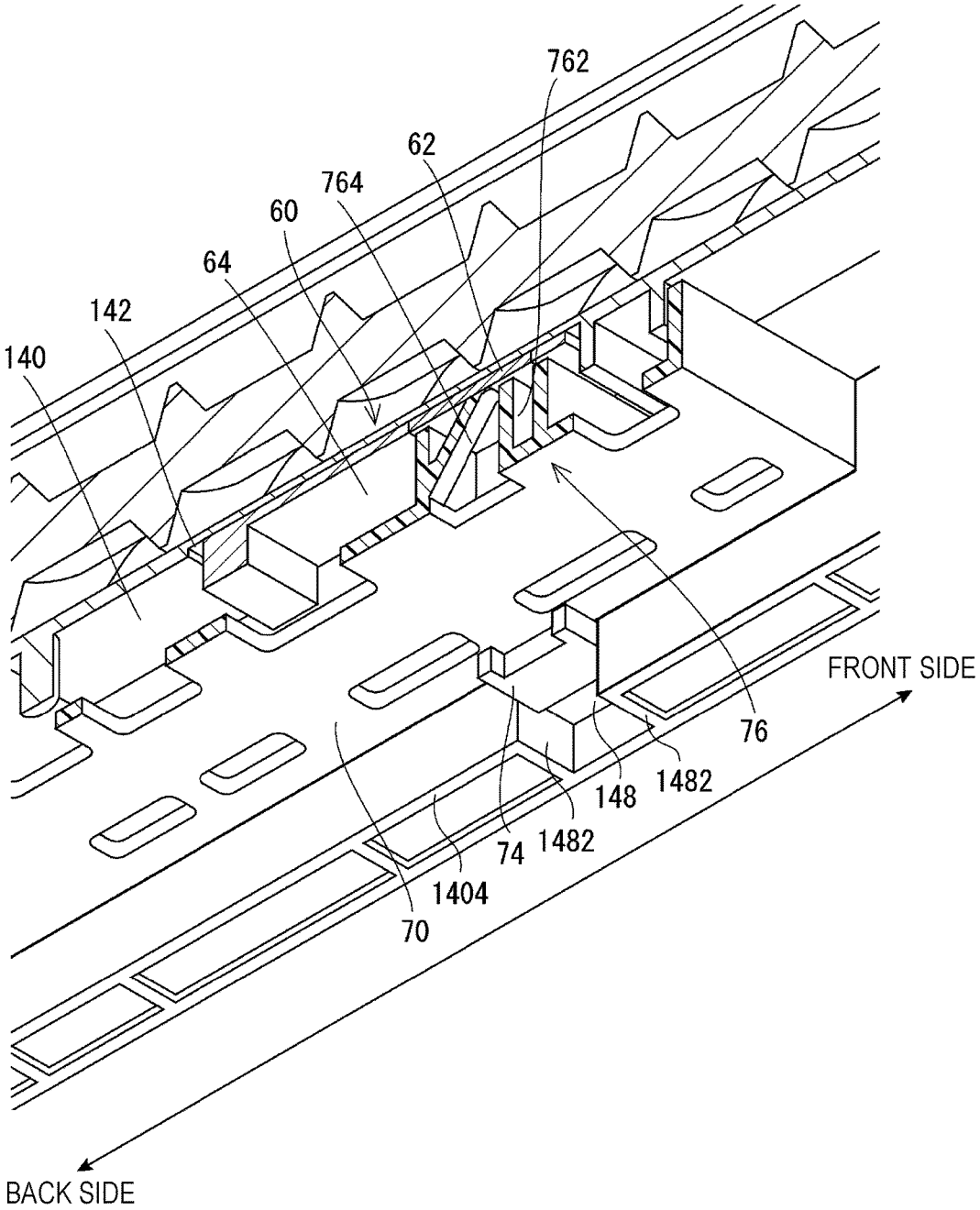
FIG. 7 is a schematic cross-sectional view of a development device viewed diagonally from below.

Hereinafter, a structure of the cover member 70 and an attachment mechanism of the toner concentration detection sensor 60 will be described with reference to FIG. 2, FIG. 7, and other drawings. FIG. 2 is a bottom view of the development device 14 in FIG. 1. FIG. 4 is a bottom view of the development device 14 to which the cover member 70 is attached. FIG. 5A is a top view of the cover member 70. FIG. 5B is a side view of the cover member 70. FIG. 5C is a perspective view of the cover member 70 viewed diagonally from above. FIG. 6 is a schematic cross-sectional side view of the development device 14. FIG. 7 is a schematic cross-sectional view of the development device 14 viewed diagonally from below. A front-back direction, an up-down direction, and a left-right direction in the cover member 70 are a front-back direction, an up-down direction, and a left-right direction in a state in which the cover member 70 is attached to the developer housing 140 (development device 14) and the development device 14 is attached to the image forming apparatus 10.

As illustrated in FIG. 2, the toner concentration detection sensor 60 is attached to the lower surface (bottom wall) of the developer housing 140. On the lower surface of the developer housing 140, ribs 1402 and 1404 that extend in the front-back direction are provided. The ribs 1402 and 1404 are parallel to each other. Between the ribs 1402 and 1404, a position (sensor attachment position) to which the toner concentration detection sensor 60 is attached is set. A sensor attachment section 142 is formed at the sensor attachment position on the lower surface of the developer housing 140. The sensor attachment section 142 is a recessed portion formed on the bottom wall of the developer housing 140 and has a substantially rectangular shape when viewed from below (above). The size of the sensor attachment section 142 in the front-back direction and the left-right direction (horizontal direction) is slightly larger than the size (the size in the horizontal direction) of the outer shape of the toner concentration detection sensor 60. As illustrated in FIG. 2, FIG. 6, and FIG. 7, the thickness of the bottom wall of the developer housing 140 in the sensor attachment section 142 is thinner than that in other sections. The toner concentration detection sensor 60 is attached to the sensor attachment section 142 with a double-faced tape or an adhesive. The thickness of the double-faced tape or the adhesive is within the range of 0.01 to 0.3 mm. Preferably, the thickness of the double-faced tape or the adhesive is within the range of 0.05 to 0.15 mm.

The toner concentration detection sensor 60 includes a sensor member (sensor section) 62 and a base plate 64 that supports the sensor member 62. The sensor member 62 may be a transmissive optical sensor, a reflective optical sensor, or a magnetic permeability sensor. Among the example optical sensors, it is preferable that a magnetic permeability sensor be used. The magnetic permeability varies depending on the proportion of the magnetic material in the developer. In other words, when the mixing ratio of the magnetic material (carrier) and the nonmagnetic material (toner) in the developer, that is, the relative concentration of the magnetic material changes, the output of the magnetic permeability sensor changes. Accordingly, by detecting the magnetic permeability of the developer, the concentration of the carrier, which is the magnetic material in the developer, can be measured. Based on the measured concentration of the carrier, the concentration of the toner, which is the nonmagnetic material in the developer, can be calculated (detected).

The cover member 70 is formed of a synthetic resin similarly to the developer housing 140 and some other components, and has a substantially rectangular shape elongated in the front-back direction. The size of the cover member 70 in the front-back direction and the left-right direction (horizontal direction) viewed below (above) is larger than the size of the toner concentration detection sensor 60 in the horizontal direction and the size of the sensor attachment section 142 in the horizontal direction. The cover member 70 covers the toner concentration detection sensor 60 when the cover member 70 is attached to the developer housing 140. The size of the cover member 70 in the left-right direction is substantially the same as the distance between the rib 1402 and the rib 1404 that are disposed on the bottom wall of the developer housing 140. In other words, the cover member 70 is attached so as to be fitted between the rib 1402 and the rib 1404.

The cover member 70 includes engaging claws 72, contact pieces 74, and a pressing section 76 as illustrated in FIG. 4, FIG. 5A, FIG. 5B, and FIG. 5C.

The four engaging claws 72 are provided in the front and the back of the end portions on the left side of the cover member 70 and in the front and the back of the end portions on the right side of the cover member 70. The two engaging claws 72 on the left and right sides in the front are disposed to correspond to each other in the front-back direction. The two engaging claws 72 on the left and right sides in the back are disposed to correspond to each other in the front-back direction.

The four contact pieces 74 are provided in the front and the back of the end portions on the left side of the cover member 70 and in the front and the back of the end portions on the right side of the cover member 70. The two contact pieces 74 on the left and right sides in the front are disposed to correspond to each other in the front-back direction. The two contact pieces 74 on the left and right sides in the back are disposed to correspond to each other in the front-back direction. Furthermore, the contact pieces 74 on the front side are disposed in the vicinity of the back side of the engaging claws 72 that are disposed on the front side, and the contact pieces 74 on the back side are disposed in the vicinity of the back side of the engaging claws 72 that are disposed on the back side.

As described above, when viewed from below (above), the engaging claws 72 and the contact pieces 74 are disposed at the four corners of the cover member 70.

As illustrated in FIG. 6, fitting holes 146 are formed in the ribs 1402 and 1404 of the developer housing 140 to correspond to the engaging claws 72 of the cover member 70 when the cover member 70 is in a position (hereinafter, may be simply referred to as "cover attachment position) where the cover member 70 is attached to the developer housing 140. Consequently, when the cover member 70 is in the cover attachment position, the engaging claws 72 engage with the lower end edges of the fitting holes 146 from the upper side. The engagement of the engaging claws 72 with the fitting holes 146 regulates the downward movement of the cover member 70. Although not illustrated in FIG. 6, the fitting holes 146 are formed in the ribs 1402 and the 1404 to correspond to the respective four engaging claws 72.

As illustrated in FIG. 7, in the ribs 1402 and 1404 of the developer housing 140, contact portions 148 are formed to correspond to the contact pieces 74 of the cover member 70 when the cover member 70 is in the cover attachment position. The rib height of each contact portion 148 is lower (the position of the lower end portion is the upper side) than the other portions in the ribs 1402 and 1404. The size of the contact portion 148 in the front-back direction is slightly larger than the size of the contact piece 74 of the cover member 70 in the front-back direction. The contact pieces 74 of the cover member 70 are brought into contact with the contact portions 148 from the lower side and thereby the upward movement of the cover member 70 can be regulated. Although not illustrated in FIG. 7, the contact portions 148 are formed in the ribs 1402 and the 1404 to correspond to the respective four contact pieces 74.

As described above, the engagement of the engaging claws 72 with the fitting holes 146 and the contact of the contact pieces 74 with the contact portions 148 can regulate the upward and downward movement of the cover member 70. The contact pieces 74 are held in the front-back direction by walls 1482 that are part of the contact portions 148 in the ribs 1402 and 1404. Accordingly, the movement of the cover member 70 in the front-back direction can be regulated to a predetermined amount (the spaces between the contact piece 74 and the walls 1482) or less. Furthermore, the size of the cover member 70 in the left-right direction is substantially the same as the distance between the ribs 1402 and 1404, and the movement of the cover member 70 in the left-right direction can be regulated.

Furthermore, as illustrated in FIG. 4, FIG. 5A, and FIG. 5C, the cover member 70 according to the first embodiment has an insertion hole 78 for fastening. The insertion hole 78 is formed to correspond to a boss 144 for fastening (see FIG. 2) that is provided on the bottom wall of the developer housing 140 when the cover member 70 is in the cover attachment position. A fastening member 150 such as a screw is fastened into the boss 144 via the insertion hole 78 from the lower side of the cover member 70 to fix the cover member 70 to the developer housing 140.

As described above, the cover member 70 is attached (fixed) to the developer housing 140 by engagement and fastening. The cover member 70 is detached from the developer housing 140 by releasing the engagement and fastening. In other words, the cover member 70 is detachably attached to the developer housing 140. The above-described method of fixing the cover member 70 is a mere example and the method is not limited to this example. For example, the cover member 70 may be attached to the developer housing 140 only by fastening or may be attached to the developer housing 140 only by engagement. When the cover member 70 is attached to the developer housing 140 only by fastening, two or more portions may be fastened.

As illustrated in FIG. 5A to FIG. 5C, in the front-back direction, the pressing section 76 is located between the engaging claw 72 on the front side and the contact piece 74 on the front side. The pressing section 76 includes a hard portion 762 and an elastic portion 764. The hard portion 762 is a substantially rectangular rib (fixing rib) that extends in the up-down direction. The elastic portion 764 is a leaf spring that can elastically deform at least in the up-down direction. The hard portion 762 is not easily elastically deformed at least in the up-down direction as compared to the elastic portion 764. An upper end surface (a surface that faces the toner concentration detection sensor 60) of the hard portion 762 in the up-down direction is located at substantially the same position as the position of a lower surface of the toner concentration detection sensor 60 when the cover member 70 is in the cover attachment position. That is, when the cover member 70 is in the cover attachment position, the upper end surface of the hard portion 762 comes into contact with the lower surface of the toner concentration detection sensor 60. Accordingly, as illustrated in FIG. 6 and FIG. 7, when the cover member 70 is in the cover attachment position, the hard portion 762 presses the toner concentration detection sensor 60 against the bottom wall of the developer housing 140.

The position of the upper end surface (the surface that faces the toner concentration detection sensor 60) of the elastic portion 764 in the up-down direction is higher than that of the upper end surface of the hard portion 762. In other words, the upper end surface of the elastic portion 764 protrudes above the upper end surface of the hard portion 762. Accordingly, the position of the upper end surface of the elastic portion 764 in the up-down direction is higher than that of the lower surface of the toner concentration detection sensor 60 when the cover member 70 is in the cover attachment position. Consequently, when the cover member 70 is in the cover attachment position, a part of the elastic portion 764 interferes with the toner concentration detection sensor 60. Since the elastic portion 764 is the leaf spring that is elastically deformable in the up-down direction, when the cover member 70 is in the cover attachment position, the elastic portion 764 elastically deforms downward to elastically press the toner concentration detection sensor 60 against the bottom wall of the developer housing 140.

Furthermore, at least a part of the pressing section 76 overlaps the sensor member 62 of the toner concentration detection sensor 60. In this first embodiment, the hard portion 762 and the elastic portion 764 are disposed (within the range of the sensor member 62) to correspond to the sensor member 62. Consequently, the pressing section 76 (the hard portion 762 and the elastic portion 764) presses the sensor member 62 against the bottom wall of the developer housing 140.

In the first embodiment, the cover member 70 that covers the toner concentration detection sensor 60 is provided on the lower surface of the developer housing 140 such that the pressing section 76 of the cover member 70 presses the toner concentration detection sensor 60 against the lower surface of the developer housing 140. Consequently, the loose fixation of the toner concentration detection sensor 60 can be reduced and the distance from the toner concentration detection sensor 60 to the inner surface of the developer housing 140 can be maintained constant. In other words, the accuracy of the attachment position of the toner concentration detection sensor 60 to the bottom wall of the developer housing 140 can be increased. Accordingly, the toner concentration in the developer housing 140 can be appropriately detected.

Furthermore, in the first embodiment, the pressing section 76 is disposed at the position corresponding to the sensor member 62 so as to press the sensor member 62 against the bottom wall of the developer housing 140. Consequently, the distance from the sensor member 62 to the inner surface of the developer housing 140 can be maintained constant, and the toner concentration in the developer housing 140 can be appropriately detected.

Furthermore, according to the first embodiment, the pressing section 76 includes the hard portion 762 that presses the toner concentration detection sensor 60 and this structure can effectively reduce the loose fixation of the toner concentration detection sensor 60.

Furthermore, according to the first embodiment, the pressing section 76 includes the elastic portion 764 that elastically deforms in the up-down direction to press the toner concentration detection sensor 60 against the bottom wall of the developer housing 140. This structure can effectively reduce the loose fixation of the toner concentration detection sensor 60.

In the first embodiment, the pressing section 76 presses the sensor member 62; however, this structure is not limited to this example as long as at least a part of the toner concentration detection sensor 60 is pressed against the bottom wall of the developer housing 140. For example, the pressing section 76 may press the periphery of the sensor member 62 on the base plate 64 or may press both the sensor member 62 and the base plate 64. Furthermore, the position of the upper end surface of the hard portion 762 in the up-down direction may be away from the lower surface of the toner concentration detection sensor 60 when the cover member 70 is in the cover attachment position. In such a case, the hard portion 762 does not press the toner concentration detection sensor 60 and only the elastic portion 764 presses the toner concentration detection sensor 60 (sensor member 62). With these examples, similarly to the above-described embodiment, the loose fixation of the toner concentration detection sensor 60 can be reduced.

Second Embodiment

In an image forming apparatus 10 according to a second embodiment, a part of the development device 14 is modified and other structures are similar to those in the image forming apparatus 10 according to the first embodiment. Accordingly, the descriptions of the similar structures are omitted.

Figure 8:
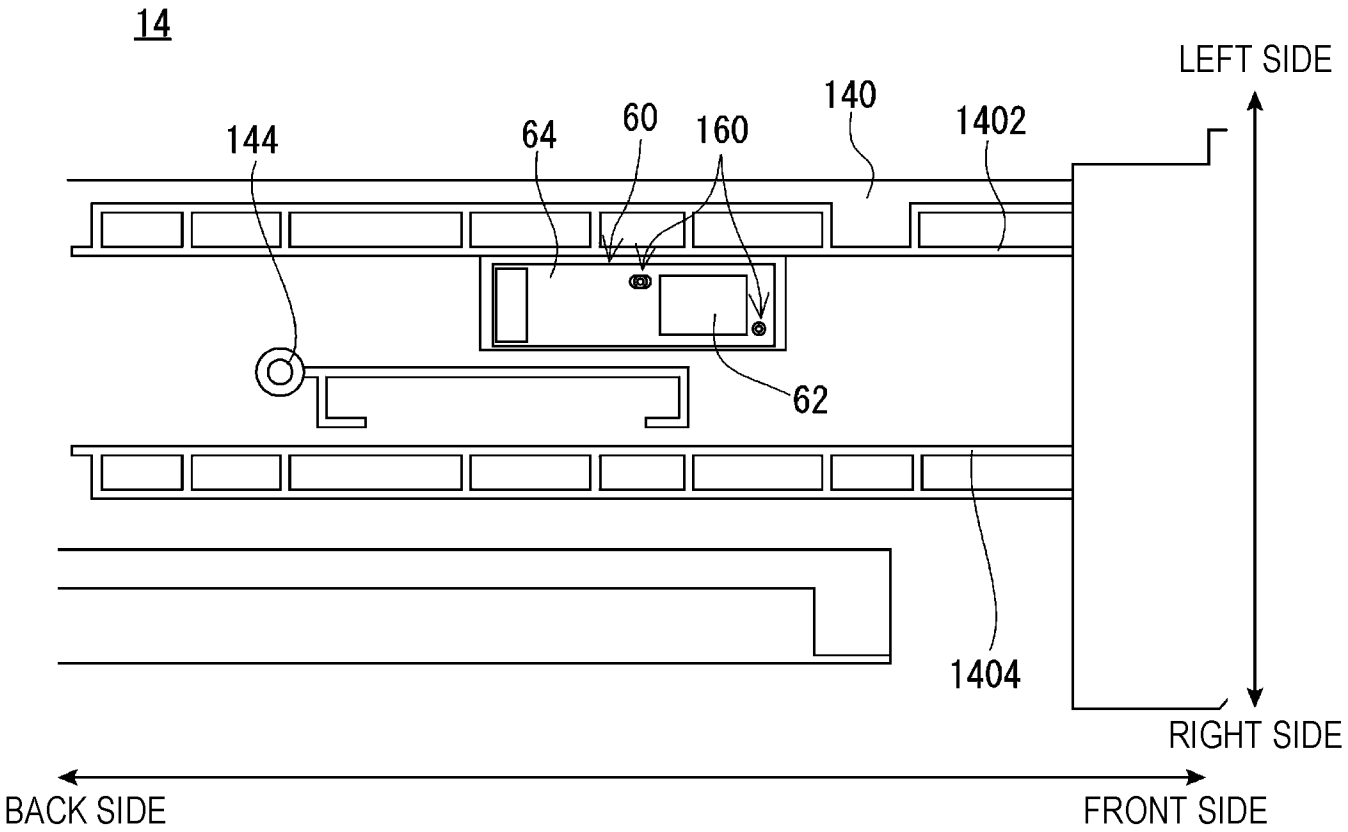
FIG. 8 is a bottom view of a development device according to a second embodiment.
Figure 9:
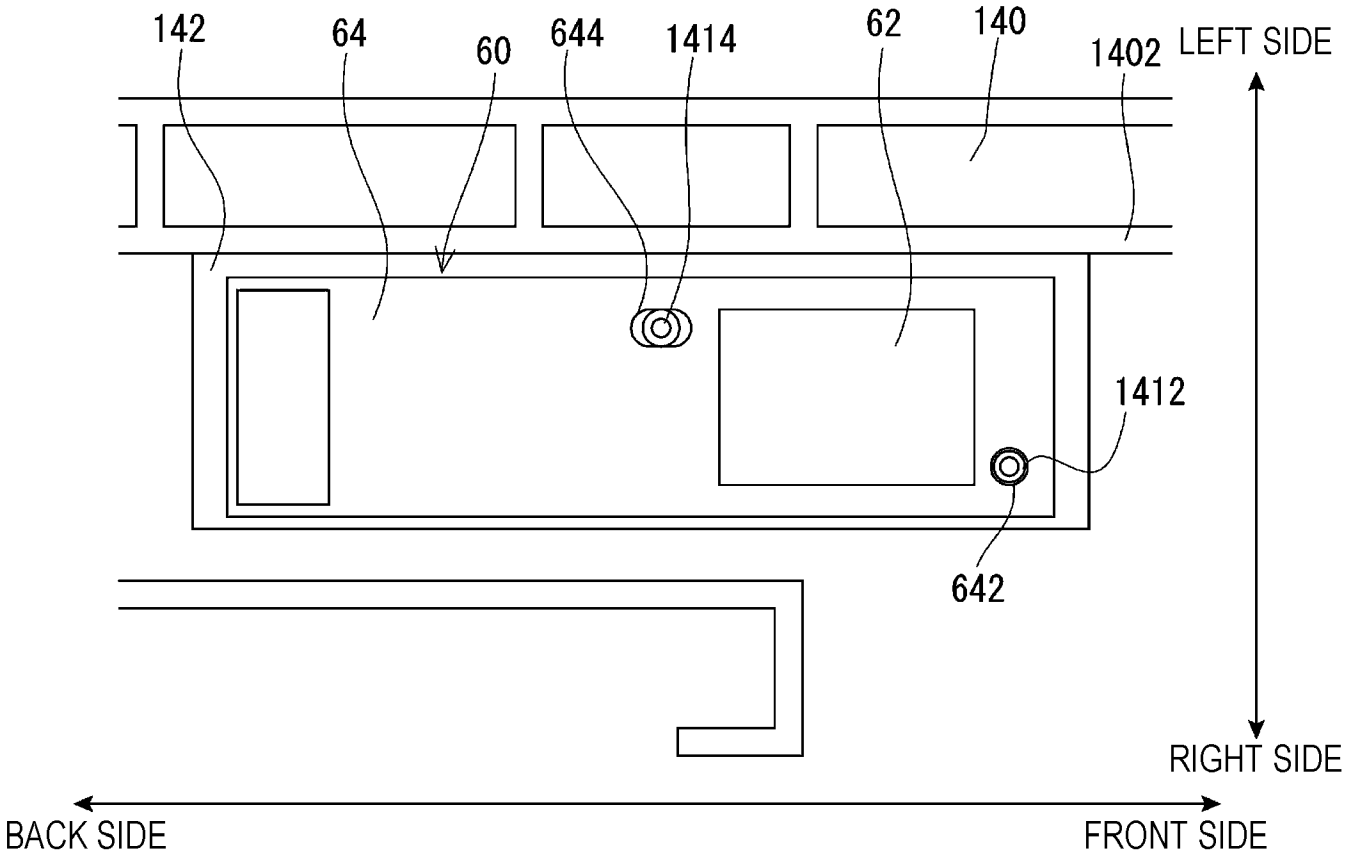
FIG. 9 is a schematic enlarged view of a part of a development device according to the second embodiment.
Figure 10:
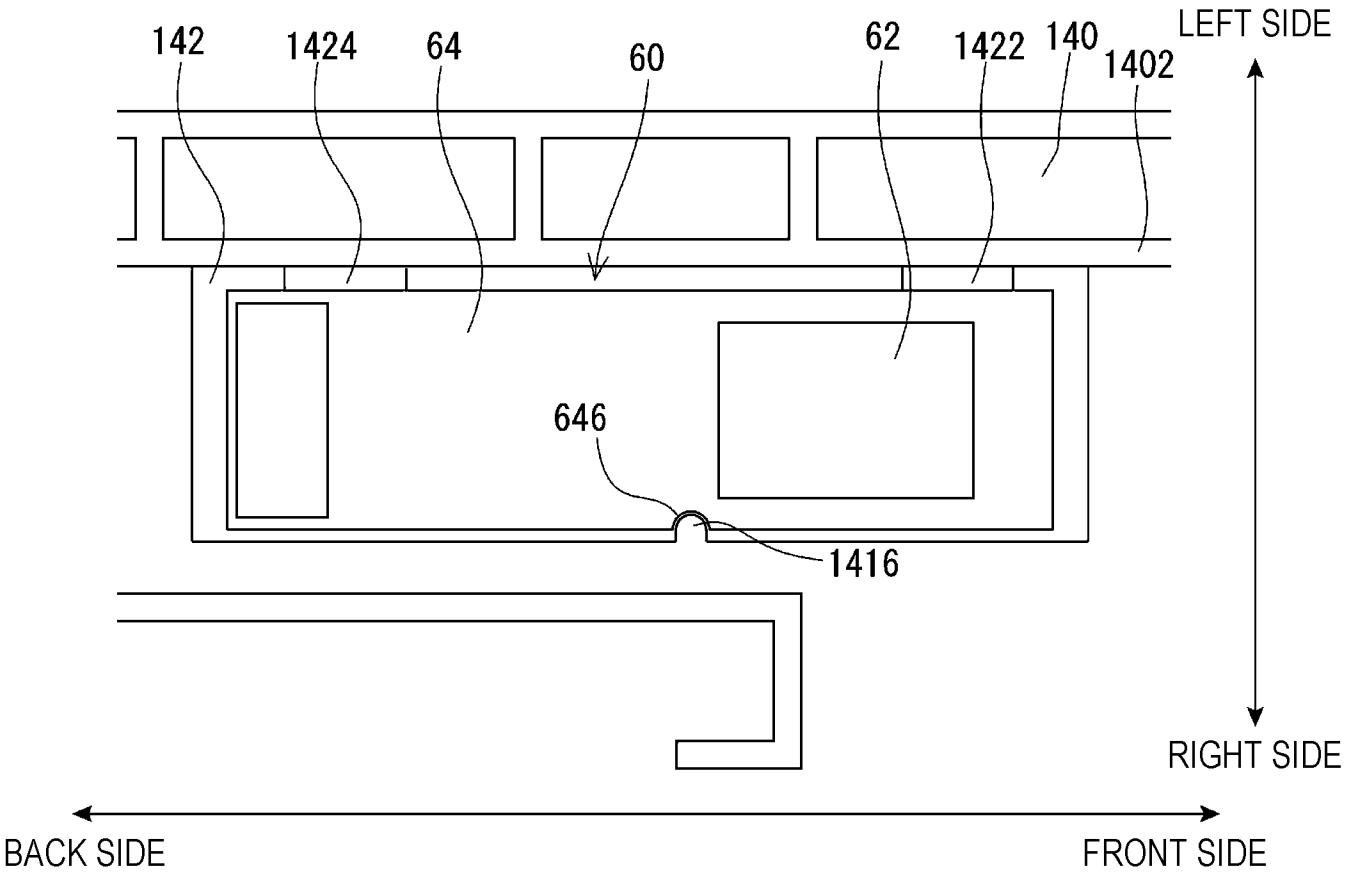
FIG. 10 is a schematic enlarged bottom view of a part of a development device according to a modification.

FIG. 8 is a bottom view of a development device 14 according to the second embodiment. FIG. 9 is a schematic enlarged view of a part of the development device 14 according to the second embodiment. FIG. 10 is a schematic enlarged bottom view of a part of the development device 14 according to a modification.

As illustrated in FIG. 8, the second embodiment includes a positioning section 160 that determines a position of the toner concentration detection sensor 60 with respect to the developer housing 140 in the horizontal direction, which is a direction perpendicular to the direction the toner concentration detection sensor 60 is attached to the developer housing 140 or the pressing direction of the pressing section 76.

Hereinafter, a specific example of the positioning section 160 will be described. For example, as illustrated in FIG. 9, on the bottom wall of the developer housing 140, a first protrusion 1412 and a second protrusion 1414 that protrude downwardly from the bottom wall of the developer housing 140 are formed. In the base plate 64 of the toner concentration detection sensor 60, a first positioning hole 642 and a second positioning hole 644 are formed. When the toner concentration detection sensor 60 is in the sensor attachment position, the first protrusion 1412 and the first positioning hole 642 are located so as to correspond to each other, and the second protrusion 1414 and the second positioning hole 644 are located so as to correspond to each other.

The first protrusion 1412, the second protrusion 1414, the first positioning hole 642, and the second positioning hole 644 are disposed in the vicinity of the sensor member 62. Specifically, the first protrusion 1412 and the first positioning hole 642 are disposed in front of the sensor member 62 on the right side, and the second protrusion 1414 and the second positioning hole 644 are disposed behind the sensor member 62 on the left side. In other words, the first protrusion 1412 and the first positioning hole 642 and the second protrusion 1414 and the second positioning hole 644 are disposed diagonally across the sensor member 62 when viewed from below (above).

Each of the first protrusion 1412 and the second protrusion 1414 is a columnar or cylindrical protrusion (resin boss). In the second embodiment, the outer diameter of the first protrusion 1412 and the outer diameter of the second protrusion 1414 are substantially the same. The first positioning hole 642 is a round hole and the inner diameter of the first positioning hole 642 is slightly larger than the outer diameter of the first protrusion 1412. The second positioning hole 644 is an elongated hole (slotted hole) that extends in the front-back direction. The width of the second positioning hole 644 in the left-right direction is slightly wider than the outer diameter of the second protrusion 1414, and the width of the second positioning hole 644 in the front-back direction is about 1.5 times the outer diameter of the second protrusion 1414.

In the example in FIG. 9, when the toner concentration detection sensor 60 is in the sensor attachment position, the first protrusion 1412 is inserted into the first positioning hole 642 and the second protrusion 1414 is inserted into the second positioning hole 644. In this state, the first positioning hole 642 (the first protrusion 1412) is a reference (main reference) of the toner concentration detection sensor 60 in the horizontal direction with respect to the developer housing 140. The second positioning hole 644 is a reference (sub reference) of the toner concentration detection sensor 60 in the left-right direction with respect to the developer housing 140, and regulates the rotation of the toner concentration detection sensor 60 about the first positioning hole 642. In the example in FIG. 9, each of the first protrusion 1412, the second protrusion 1414, the first positioning hole 642, and the second positioning hole 644 functions as the positioning section 160 to determine a position of the toner concentration detection sensor 60 in the horizontal direction with respect to the developer housing 140.

Next, another example of the positioning section 160 will be described. For example, as illustrated in FIG. 10, a first contact portion 1422 and a second contact portion 1424 that protrude toward the right side are formed in the left end section of the sensor attachment section 142. The first contact portion 1422 and the second contact portion 1424 come into contact with the left end surface of the toner concentration detection sensor 60 when the toner concentration detection sensor 60 is in the sensor attachment position. The first contact portion 1422 is disposed to come into contact with an end portion on the front side on the left end surface of the toner concentration detection sensor 60. The second contact portion 1424 is disposed to come into contact with an end portion on the back side on the left end surface of the toner concentration detection sensor 60.

A fitting protrusion 1416 that protrudes toward the left side (the side the first contact portion 1422 and the second contact portion 1424 are disposed) is formed in the right end section of the sensor attachment section 142. The protrusion 1416 has a semicircular tip (end portion on the left side). Furthermore, a semicircular notch portion 646 is formed to correspond to the protrusion 1416 in the right end surface (right end edge) of the base plate 64 of the toner concentration detection sensor 60. The inner diameter of the notch portion 646 is slightly larger than the outer diameter of the tip of the protrusion 1416. The protrusion 1416 and the notch portion 646 are fitted together when the toner concentration detection sensor 60 is in the sensor attachment position.

In the example in FIG. 10, when the toner concentration detection sensor 60 is in the sensor attachment position, the protrusion 1416 and the notch portion 646 are fitted and the position of the toner concentration detection sensor 60 in the front-back direction is determined. The first contact portion 1422 and the second contact portion 1424 come into contact with the left end surface of the toner concentration detection sensor 60 and the protrusion 1416 is fitted into the notch portion 646 of the right end surface of the toner concentration detection sensor 60. In other words, the toner concentration detection sensor 60 is held by the first contact portion 1422, the second contact portion 1424, and the protrusion 1416 from the left and right and thereby the position of the toner concentration detection sensor 60 in the left-right direction is determined. In the example in FIG. 10, each of the first contact portion 1422, the second contact portion 1424, the protrusion 1416, and the notch portion 646 functions as the positioning section 160 to determine a position of the toner concentration detection sensor 60 in the horizontal direction with respect to the developer housing 140.

This structure of the positioning section 160 is not limited to the above-described structure. Although not illustrated in the drawings, for example, a protrusion of a cross shape or an L shape may be provided on the bottom wall of the developer housing 140 and a positioning hole that corresponds to the protrusion may be provided in the base plate 64 of the toner concentration detection sensor 60. With this structure, by one protrusion and one positioning hole, a position of the toner concentration detection sensor 60 in the horizontal direction can be determined. Alternatively, three or more protrusions and positioning holes may be provided respectively. Furthermore, instead of the hole that corresponds to the protrusion, a notch may be provided in the end surface of the base plate 64 as illustrated in FIG. 10. Furthermore, a corner portion of the base plate 64 may be fitted to a protrusion of an L-shape or the like provided on the bottom wall of the developer housing 140.

If a plurality of protrusions are provided, the position of a lower end portion of a protrusion that is closest to the sensor member 62 is lower than the lower surface of the base plate 64 of the toner concentration detection sensor 60. In other words, the position of the protrusion that is closest to the sensor member 62 is lower than the position of the base plate 64 of the toner concentration detection sensor 60.

Figure 11:
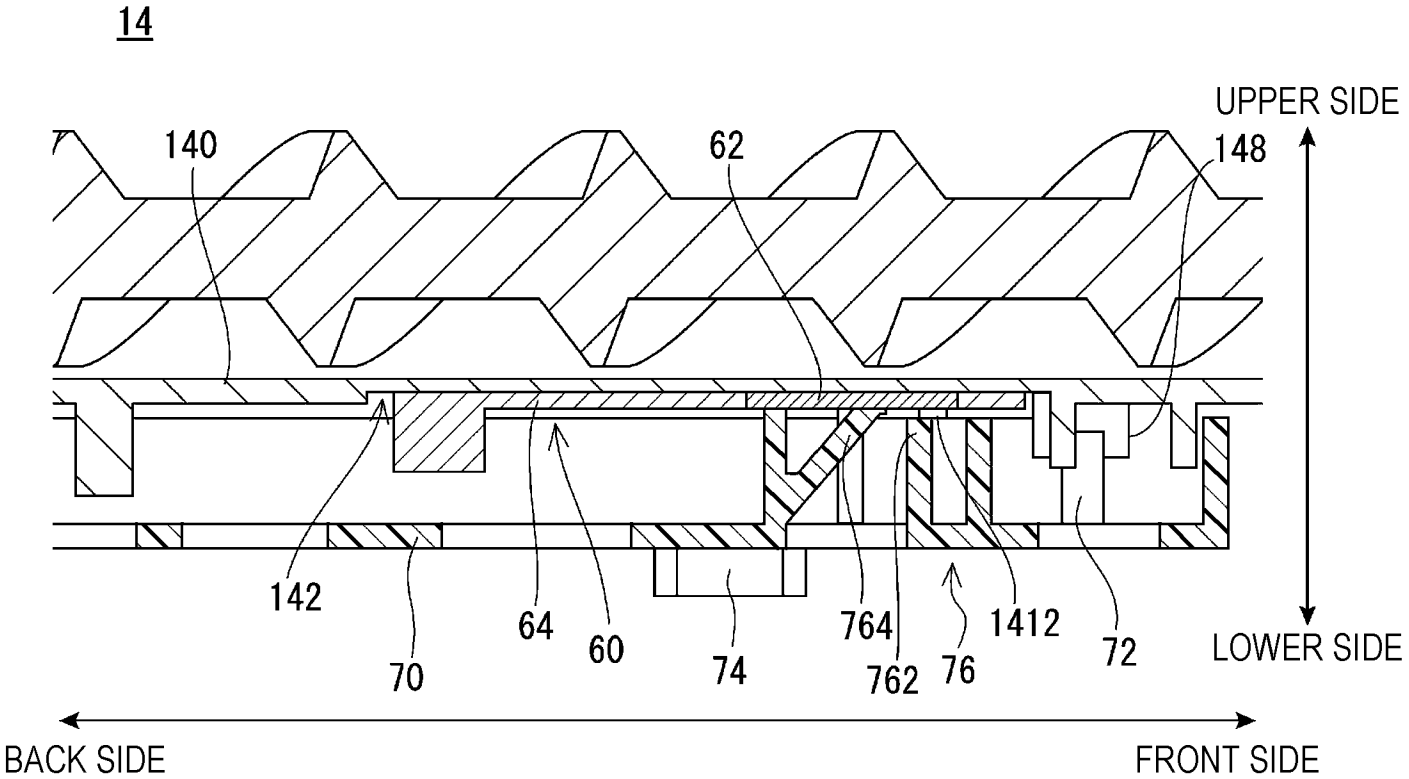
FIG. 11 is a schematic cross-sectional side view of a development device according to the second embodiment.

FIG. 11 is a schematic cross-sectional side view of the development device 14 illustrated in FIG. 9. As illustrated in FIG. 11, for example, the position of the first protrusion 1412 that is closer to the sensor member 62 than the second protrusion 1414 is lower than the position of the base plate 64 of the toner concentration detection sensor 60. In this example, a part of the cover member 70 comes into contact with the lower end surface of the first protrusion 1412. For example, the pressing section 76 (the hard portion 762) of the cover member 70 comes into contact with the lower end surface of the first protrusion 1412. In this example, when the first protrusion 1412 is in contact with a part of the cover member 70, the other protrusion (the second protrusion 1414) is not in contact with the cover member 70.

According to the second embodiment, the positioning section 160 that determines a position of the toner concentration detection sensor 60 in the horizontal direction with respect to the developer housing 140 is provided to accurately determine a position of the cover member 70 in the horizontal direction. Accordingly, the toner concentration in the developer housing 140 can be further appropriately detected.

Moreover, according to the second embodiment, the lower end surface of the protrusion that is closest to the sensor member 62 among the protrusions of the positioning section 160 comes into contact with a part of the cover member 70, and accordingly, the position of the cover member 70 around the sensor member 62 in the up-down direction can be accurately determined.

Third Embodiment

In an image forming apparatus 10 according to a third embodiment, a part of the development device 14 is modified and other structures are similar to those in the image forming apparatus 10 according to the first embodiment. Accordingly, the descriptions of the similar structures are omitted.

Figure 12A:
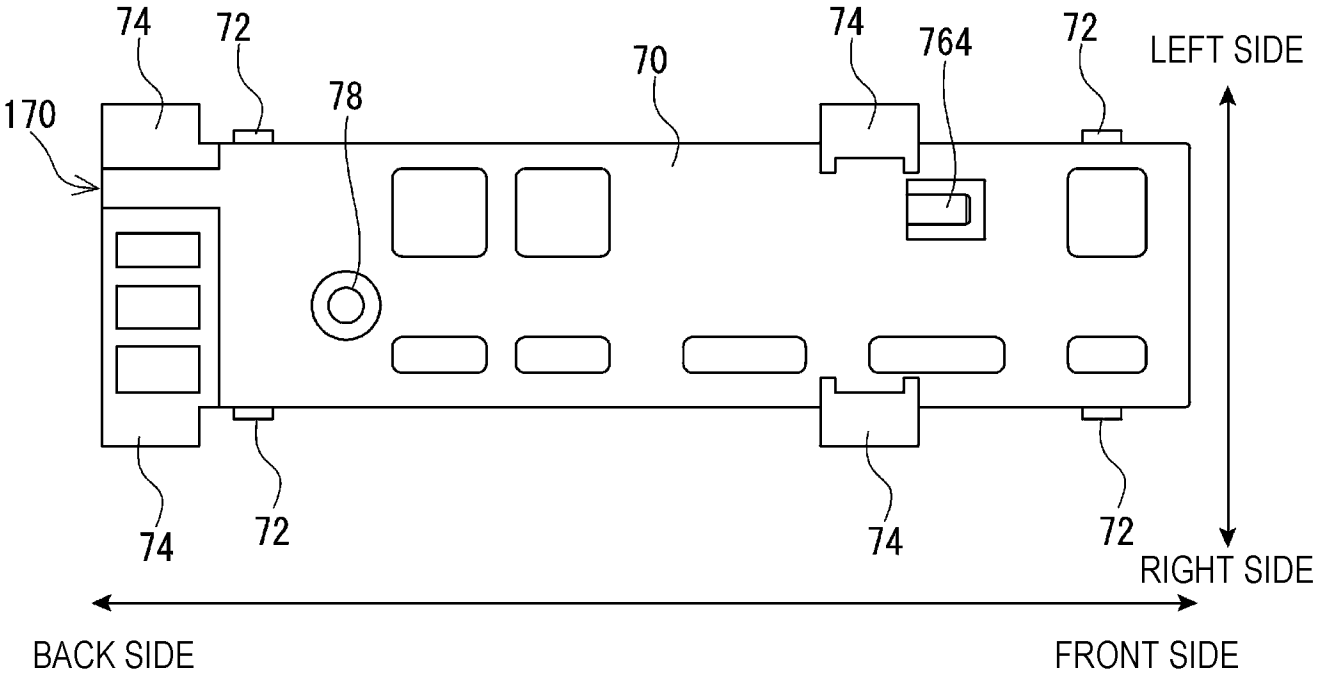
FIG. 12A is a bottom view of a cover member of a first type according to a third embodiment.
Figure 12B:
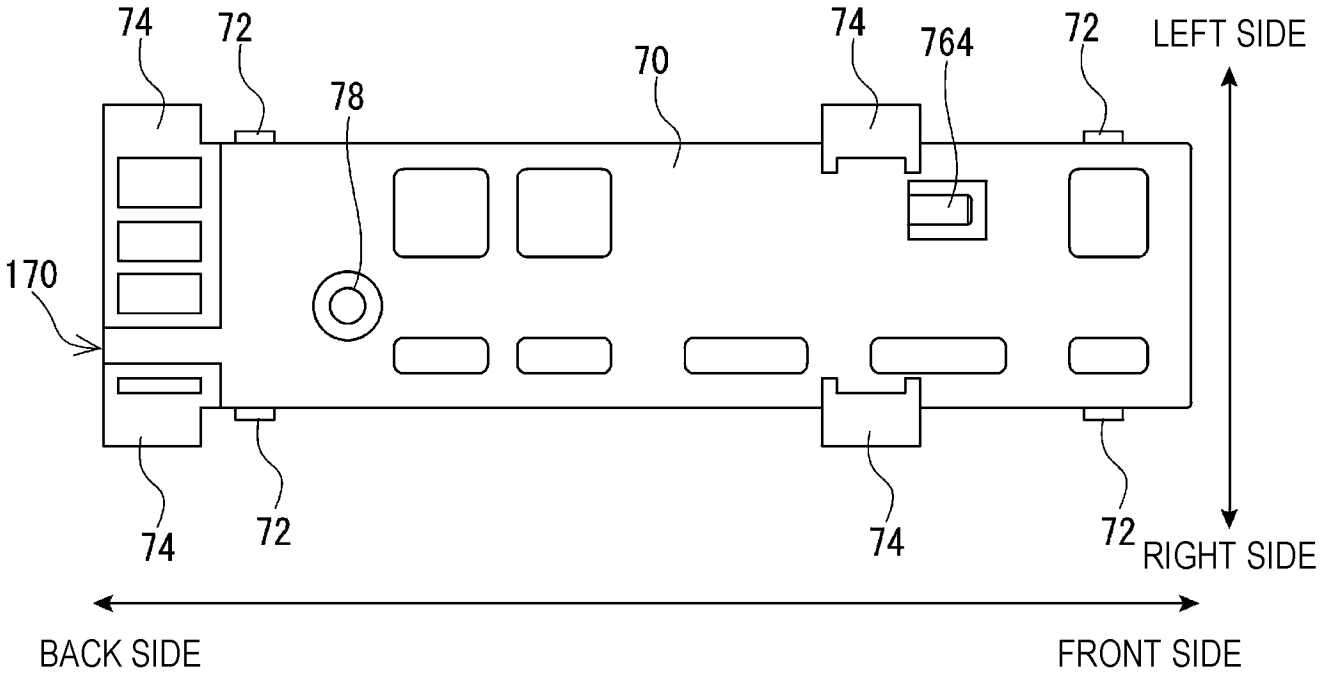
FIG. 12B is a bottom view of a cover member of a second type according to the third embodiment.

FIG. 12A is a bottom view of a cover member 70 of a first type according to the third embodiment. FIG. 12B is a bottom view of a cover member 70 of a second type according to the third embodiment. As described above, the image forming apparatus 10 includes four image stations and four types of development devices 14 that correspond to respective colors.

As illustrated in FIG. 12A and FIG. 12B, in the third embodiment, the cover member 70 includes a first identification section 170. The first identification section 170 identifies the type of the cover member 70 and the type of the development device 14 to which the cover member 70 is attached. For example, the first identification section 170 is provided at an end portion of the cover member 70 on the back side and is a concave portion (linear slit) that extends in the front-back direction.

The first identification section 170 is provided to correspond to a type (color) of the development device 14 in the left-right direction. For example, as illustrated in FIG. 12A, the first identification section 170 is provided at a position closer to the left side in the first-type cover member 70. As illustrated in FIG. 12B, the first identification section 170 is provided at a position closer to the right side in the second-type cover member 70. The first-type cover member 70 is attached to a development device (the first-type development device) 14 for black, magenta, cyan, or yellow. The second-type cover member 70 is attached to a development device (the second-type development device) 14 for a color different from that of the first-type development device 14.

Although not illustrated, a second identification section that corresponds to the first identification section 170 is provided to the casing 10*a* of the image forming apparatus 10. For example, the second identification section is provided so as to correspond to the first identification section 170 and is a convex portion (linear rib) that extends in the front-back direction. The second identification section is provided on the development device attachment section in the casing 10*a* onto which the development device 14 is attached and at a position (a position of the first identification section 170 of the cover member 70) that corresponds to the type of the corresponding development device 14. For example, the second identification section (the second identification section for black) that is provided on the development device attachment section for black into which the development device 14 for black is inserted is provided at a position that correspond to the first identification section 170 (the first identification section 170 for black) on the cover member 70 that is attached to the development device 14 for black. The second identification section for black is provided at a position different from positions for the second identification sections (the first identification sections 170 for colors other than black) for colors other than black.

Accordingly, when the development device 14 for black is inserted into the section into which the development device 14 for black is to be inserted, since the first identification section 170 and the second identification section are provided to correspond to each other, the first identification section 170 and the second identification section do not interfere with each other. Consequently, the development device 14 can be inserted into the predetermined attachment position (development device attachment position). On the other hand, when the development device 14 for a color other than black is inserted into the section into which the development device 14 for black is to be inserted, since the first identification section 170 and the second identification section are provided at different positions, the first identification section 170 and the second identification section interfere with each other. Consequently, the development device 14 is not inserted into the development device attachment position.

According to the third embodiment, with the first identification section 170 and the second identification section, incorrect attachment of the development device to be used in another image forming apparatus can be prevented. Furthermore, in the same image forming apparatus 10, incorrect attachment of the development devices 14 of respective color can be prevented.

In this embodiment, the first identification section 170 is the concave portion and the second identification section is the convex portion; however, the second identification section may be a concave portion and the first identification section may be a convex portion.

The modification described in the third embodiment may be applied to the image forming apparatus 10 according to the second embodiment.

Fourth Embodiment

In an image forming apparatus 10 according to a fourth embodiment, a part of the development device 14 is modified and other structures are similar to those in the image forming apparatus 10 according to the first embodiment. Accordingly, the descriptions of the similar structures are omitted.

Figure 13:
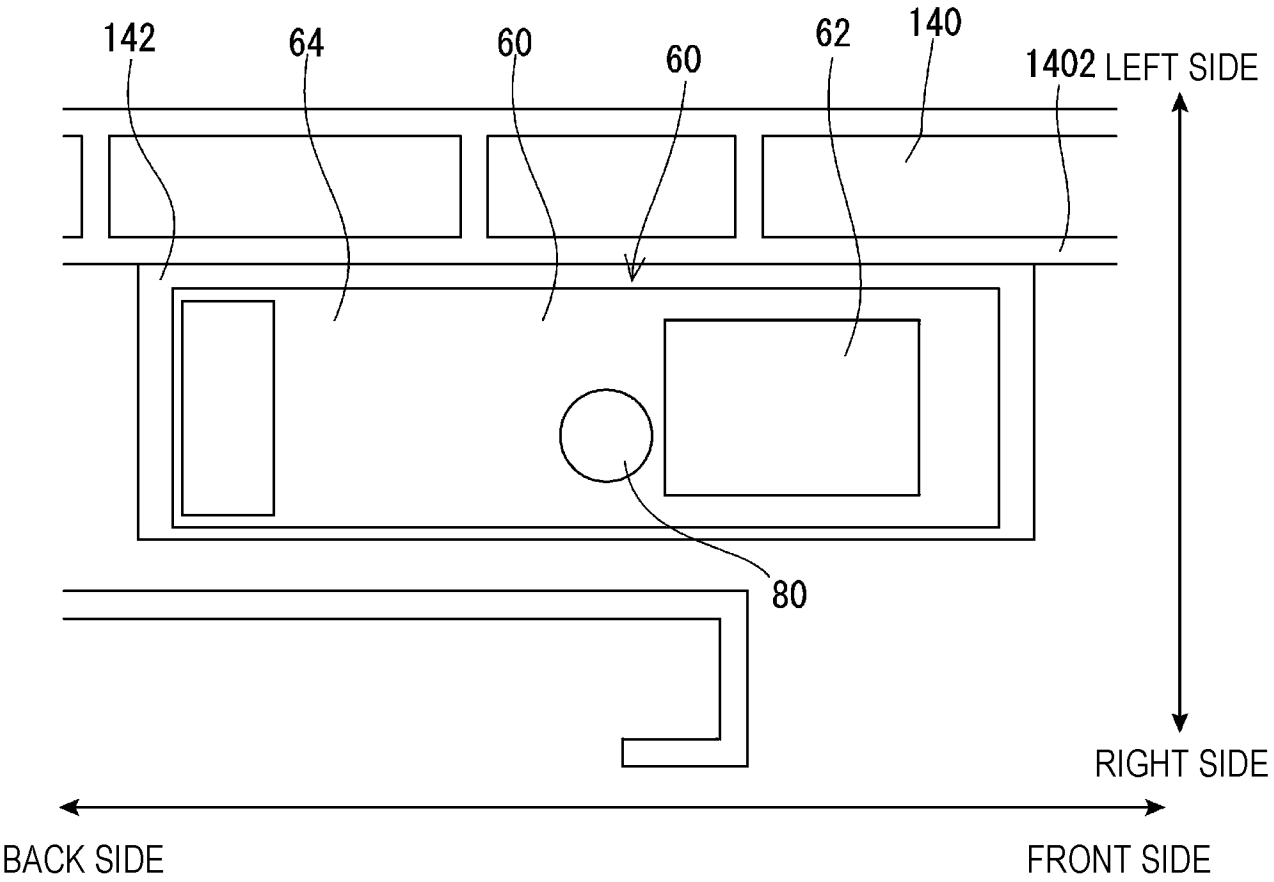
FIG. 13 is a schematic enlarged view of a part of a development device according to a fourth embodiment.

FIG. 13 is a schematic enlarged view of a part of a development device 14 according to the fourth embodiment. As illustrated in FIG. 13, in the fourth embodiment, a piezoelectric sensor 80 is provided on the lower surface of the toner concentration detection sensor 60. The piezoelectric sensor 80 is connected to the above-described CPU. Specifically, the piezoelectric sensor 80 is disposed on the lower surface of the base plate 64 of the toner concentration detection sensor 60. Furthermore, the piezoelectric sensor 80 is disposed near the sensor member 62.

At least a part of the piezoelectric sensor 80 overlaps the pressing section 76 (the hard portion 762) when viewed from below (above). Accordingly, the piezoelectric sensor 80 is pressed against the bottom wall of the developer housing 140 by the pressing section 76. With this structure, the piezoelectric sensor 80 inputs an output corresponding to the pressing force by the pressing section 76 that presses the toner concentration detection sensor 60 to the CPU. Based on the output from the piezoelectric sensor 80, the CPU calculates (detects) a pressing force to be used by the pressing section 76 to press the toner concentration detection sensor 60. For example, when the fixation of the toner concentration detection sensor 60 becomes loose, the pressing force of the pressing section 76 to press the toner concentration detection sensor 60 decreases. Accordingly, when the pressing force for pressing the toner concentration detection sensor 60 has decreased, the CPU determines that the fixation of the toner concentration detection sensor 60 has become loose.

When the CPU determines that the fixation of the toner concentration detection sensor 60 has become loose, the sensor output value of the toner concentration detection sensor 60 may be adjusted so as to correspond to the amount of loose fixation of the toner concentration detection sensor 60 (the distance from the toner concentration detection sensor 60 to the inner surface of the developer housing 140).

Furthermore, when the CPU determines that the fixation of the toner concentration detection sensor 60 has become loose, a user or a service staff may be informed of this loose fixation. For example, if the image forming apparatus 10 has a display, a message that indicates the loose fixation of the toner concentration detection sensor 60 may be displayed. If the image forming apparatus 10 has a loudspeaker, a warning sound (melody sound), a synthesized sound of a message, or the like may be output from the loudspeaker. If the image forming apparatus 10 has a warning lamp that lights up or brinks when an error occurs, the warning lamp may be turned on or blinked. Furthermore, paper on which a message that indicates an occurrence of the loose fixation of the toner concentration detection sensor 60 has been printed may be output to the display. Furthermore, not only indicating the occurrence of the loose fixation of the toner concentration detection sensor 60, but the image forming apparatus 10 may also urge a user to check the attachment state of the toner concentration detection sensor 60.

According to the fourth embodiment, the piezoelectric sensor 80 is disposed on the lower surface of the toner concentration detection sensor 60, and accordingly, the loose fixation of the toner concentration detection sensor 60 can be detected. With this structure, the sensor output value of the toner concentration detection sensor 60 can be corrected and the toner concentration in the developer housing 140 can be further accurately detected. Furthermore, the use of the inappropriate development device 14 and troubles can be prevented by notifying a user that the loose fixation of the toner concentration detection sensor 60 has occurred or by urging a user to check the attachment condition of the toner concentration detection sensor 60.

The modification described in the fourth embodiment may be applied to the image forming apparatus 10 according to the second embodiment or the third embodiment.

It is to be understood that the specific shapes and the like described in the above-described embodiments are mere examples, and may be appropriately modified for actual products.

The present disclosure contains subject matter related to that disclosed in Japanese Priority Patent Application JP 2017-234789 filed in the Japan Patent Office on Dec. 7, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A development device comprising:

a developer tank configured to store a developer;

a toner concentration sensor attached to a lower surface of the developer tank, the toner concentration sensor being configured to detect a toner concentration of the developer stored in the developer tank; and a cover member attached to the lower surface of the developer tank to cover the toner concentration sensor, wherein the cover member includes a pressing section pressing against a part of the toner concentration sensor such that the toner concentration sensor is pressed against the lower surface of the developer tank.

2. The development device according to claim 1, wherein the toner concentration sensor includes a sensor section and a holding member for holding the sensor section.

3. The development device according to claim 2, wherein the pressing section presses the sensor section.

4. The development device according to claim 2, wherein the pressing section presses the periphery of the sensor section in the holding member.

5. The development device according to claim 1, wherein the pressing section includes an elastic portion for elastically pressing a part of the toner concentration sensor.

6. The development device according to claim 1, wherein the pressing section includes a hard portion for pressing a part of the toner concentration sensor.

7. The development device according to claim 1, further comprising:

a positioning section for determining a position of the toner concentration sensor in a horizontal direction with respect to the developer tank.

8. The development device according to claim 7, wherein the positioning section is formed in the developer tank and includes a protrusion that comes into contact with an edge portion of the toner concentration sensor.

9. The development device according to claim 8, wherein a lower surface of the protrusion comes into contact with an upper surface of the pressing section.

10. The development device according to claim 1, wherein the cover member is detachably attached to the developer tank.

11. An image forming apparatus comprising:

the development device according to claim 1.

* * * * *